United States Patent [19]

Boström

[11] 4,299,695

[45] Nov. 10, 1981

[54] ROCK GRADER WITH TILTING SORTER SCREEN

[76] Inventor: Folke Boström, Lingonstigen 26, S-930 70 Mala, Sweden

[21] Appl. No.: 178,424

[22] Filed: Aug. 15, 1980

[51] Int. Cl.[3] ..... B07B 1/28

[52] U.S. Cl. ..... 209/260; 209/420

[58] Field of Search ..... 209/260, 420, 421; 298/19 V, 22 F; 414/383, 387

[56] References Cited

U.S. PATENT DOCUMENTS

| | | | |
|---|---|---|---|
| 1,278,551 | 9/1918 | Allison | 414/387 |
| 1,448,596 | 3/1923 | Kovach | 209/260 |
| 1,685,823 | 10/1928 | Mayer | 209/260 |
| 2,396,954 | 3/1946 | Kranz et al. | 209/260 |
| 2,690,840 | 10/1954 | Kohlmier | 209/260 |
| 3,402,816 | 9/1968 | Taylor | 209/260 |

FOREIGN PATENT DOCUMENTS

| | | | |
|---|---|---|---|
| 117159 | 10/1965 | Sweden | 209/260 |
| 373767 | 6/1932 | United Kingdom | 414/388 |

*Primary Examiner*—Ralph J. Hill

*Attorney, Agent, or Firm*—Sughrue, Mion, Zinn, Macpeak and Seas

[57] ABSTRACT

A grading plant with self-cleaning screen for lump materials, the screen (3) being pivotally mounted to a carriage (2) displaceable on horizontal beams (1). The screen has wheels (5) guided in tracks in the beams. Each track has a horizontal portion (11) and a curved downwards directed portion (12). The screen is in a position for discharging when the wheels (5) are in the lowermost part of the downwards directed portion. The motion of the screen (3) is exerted by a moving device consisting of a wire arrangement (7) for the backwards directed movement and a return spring (20) for the return motion, or a double-acting hydraulic cylinder (18) moving the carriage in both directions.

5 Claims, 4 Drawing Figures

Fig. 1.
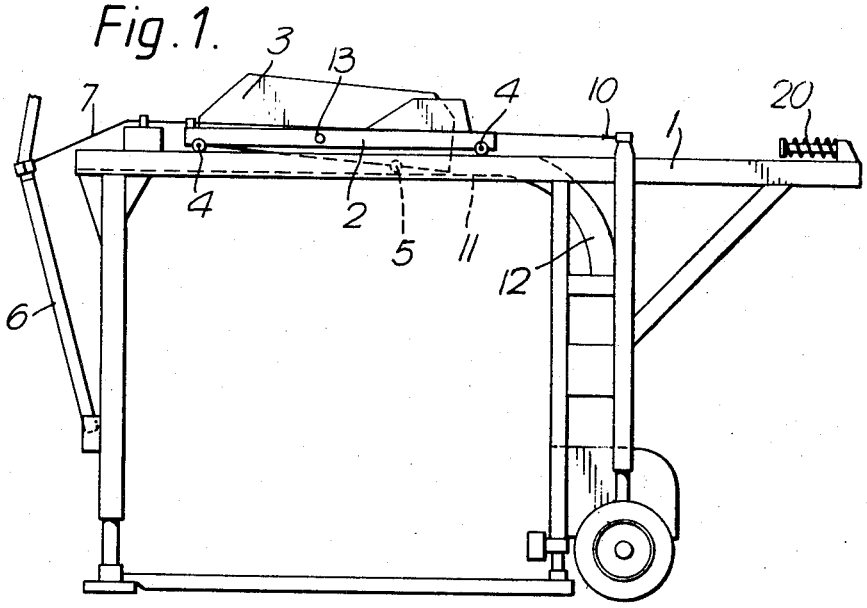
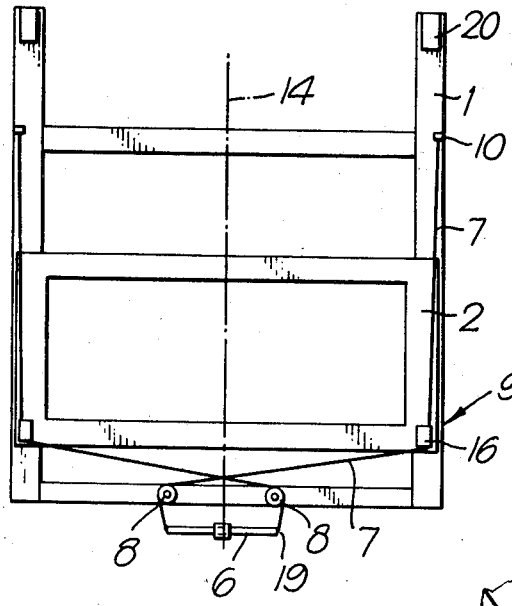
Fig. 2.
Fig. 3.
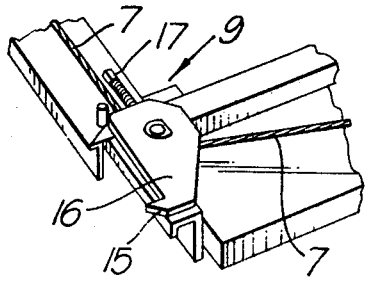

ROCK GRADER WITH TILTING SORTER SCREEN

BACKGROUND OF THE INVENTION

The invention relates to a grading plant comprising a self-cleaning screen for lump materials retaining oversize fractions compared with a predetermined material size, the screen being displaceable by means of a moving device backwards from a horizontal sorting position to a vertical discharging position, and forwards back to the sorting position, the screen being guided in tracks with a horizontal portion and a curved downwards directed portion in connection with the horizontal portion.

Such grading plants are utilized to retain oversize fractions of lump materials which are to be carried through stone crushing plants and used e.g. for levelling on building and construction sites.

The operation of crushing plants may from time to time be stopped for long periods by the jamming of too big blocks between the breaker plates. Removing of such blocks may be very work consuming and take a long time during which the production of the crushing plant will be strongly reduced. Thus, a strong demand exists to provide equipment which can sort out oversize fractions of rocks before the materials are put into the crushing plant, thereby ensuring continuous operation.

At construction sites where lump materials are taken out for later use as filling materials for levelling, road building, etc., it is desireable to be able to carry out a safe construction of such base layers by as far as possible using approximately homogeneous materials ensuring stability. By retaining undesired fractions, this may to a great extent be achieved.

U.S. Pat. Nos. 2,396,954, 2,690,840 and 3,402,816 disclose grading plants with screens pivoted upwards for discharging retained fractions. These patent specifications disclose a screen which may be pivoted about an axis at one end. This means that the distance from the place where the sorted fraction falls down to the place where the retained fraction is discharged is comparatively small. Discharging of the retained fraction demands by certain solutions a high amount of force, depending on the quantity of the fraction which is to be discharged. Discharging is effected by means of engine and mechanical transmissions or hydraulically.

U.S. Pat. No. 1,685,823 discloses a screen which is movable on wheels along a track containing a horizontal portion and a curved portion, whereby the screen is pushed until the wheels are in the curved part, whereby the retained fraction is discharged and a spring is tensioned, which spring thereupon moves the screen back to the starting position. As the entire screen with its relatively large weight is pivoted so that the center of gravity is displaced a considerable vertical distance downwards, a disproportional strong spring is required to absorb sufficient energy as to move the screen back to the correct starting position.

Norwegian Pat. No. 117 159 discloses a screen with two pairs of wheels where the pairs are guided in straight tracks forming an acute angle relative to each other. This solution gives an uncontrolled discharging of the screen, as the motion of the screen towards the discharging position starts when the weight on the protruding part of the screen exceeds a certain value, whereas the returning motion of the screen starts when the weight balance upon discharging of the retained fraction is displaced so much that the center of gravity no longer is located in the protruding part. To start the discharging motion of the screen, the materials preferably have to be put on the protruding part of the screen.

The return motion of the screens according to the two last mentioned patent specifications is not ensured to be executed quite forwards to the sorting position.

SUMMARY OF THE INVENTION

It is an object of the present invention to provide a grading plant which ensures effective discharging of the retained fraction at a safe distance from the position where the sorted fraction falls down and to ensure a correct return motion of the screen to the starting position, combined with a simple and rugged design.

The grading plant according to the invention is of the type set forth above and is constructed as a portal where the transportation lorry may be placed for collection of the sorted fractions. The screen of the grading plant is approximately in its lateral center axis of gravity pivotally supported in bearings in the sides of a carriage, the carriage being horizontally displaceable by wheels attached to the sides of the carriage and rolling on fixed horizontal beams of the grading plant below the sides of the carriage, the screen being provided with two wheels attached to the rear end thereof, the wheels being guided in a track provided at each horizontal beam, the screen being in the position for discharging the retained fraction when the wheels are in the lower part of the curved portion, and the screen being in the sorting position when the wheels are in the forward part of the horizontal portion of the track.

The moving device of the grading plant comprises two symmetrically arranged wires, each of which is attached to a wire bracket at the rear end of the beam and is further being guided through a disc attached to the front end of the carriage, further guided through a pulley fixed relatively to the beams at the other side of the longitudinal axis of symmetry of the carriage, to a disengagement lever which, by movement away from the carriage, causes tension of the wire and, by the pressure against the disc, displaces the carriage in the direction away from the disengagement lever towards the rear end of the beams.

The discs are arranged on two locking means locking the carriage when the screen is in the sorting position. Each locking means comprises a plate pivotally mounted to the front end of the carriage and has a hook which is biased by a spring acting on the plate, the hook thereby being pressed into a corresponding hook mounted on the beam. The locking arrangement is disconnected and releases the carriage when the wire arrangement is tensioned by moving the disengagement lever in a direction away from the carriage.

A return spring is arranged on the rear end of the beam and is adapted to absorb the kinetic energy from the carriage and the retained fraction of the screen by bringing the backward motion of the carriage to an end by the spring, the spring thereby giving off this energy by moving the carriage back to its locked position at the front end of the beams.

In another embodiment, the moving device comprises a double-acting hydraulic cylinder arranged on each beam and in the longitudinal direction of the beams, and a piston connected to the carriage for providing the reciprocating motion of the carriage, the hydraulic cylinders being activated by mechanical-electrical or electronic-electrical actuation of control valves.

BRIEF DESCRIPTION OF THE DRAWINGS

In the following the invention will be further described by way of example with reference to the accompanying drawings, in which FIG. 1 illustrates a side elevation of the grading plant;

FIG. 2 illustrates a plan view of the wire arrangement;

FIG. 3 shows a detail illustration of the plate of the locking arrangement; and

DETAILED DESCRIPTION OF THE PREFERRED EMBODIMENTS

Figure 4:
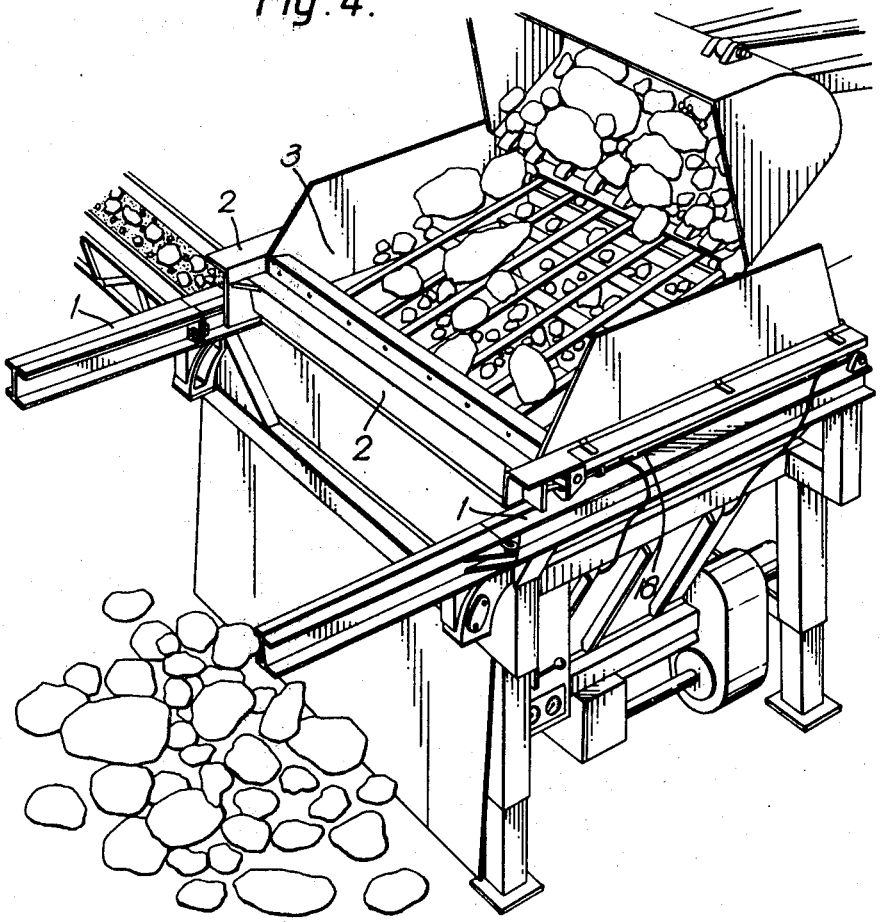
FIG. 4 shows in perspective an embodiment with hydraulic cylinders for the motion of the carriage.

A carriage 2 can roll on beams 1 by means of wheels 4. The carriage 2 comprises a frame and has a screen 3 which is arranged within the frame and is pivotally mounted in pivoting supports 13 in the center axis of gravity. On the screen 3 are mounted two wheels 5 which can roll on a horizontal portion 11 and a curved portion 12 as a continuation thereto of a track mounted to each beam. Rock materials are filled into the screen 3 and the sorted fraction falls down through the screen onto a suitable transportation machine (not shown) below the beams 1, within the portal of the grading plant. The loading machine, e.g. a shovel loader, which has delivered the materials on the screen, thereafter trips a disengagement lever 6 to the left in FIG. 1, whereby a wire 7 is tightened, a locking plate 16 is turned towards the axis of symmetry of the grading plant, thereby releasing the locking plate 16, whereafter the carriage 2 with its load is forced to the right in FIG. 1, caused by the tightening of the wire 7 between a pulley 8 and a wire bracket 10, and against a disc 9 on the carriage. When the carriage is moved to the right in FIG. 1, the screen will stay in the same position by means of the wheel 5 until the wheel 5 enters the curved portion 12 of the track, whereby the screen will be turned to a position wherein the upper surface of the screen forms an angle of less than 90° with the horizontal plane. Hereby the retained fraction will fall down on the right side of the grading plant as shown in FIG. 1. When the screen achieves its discharging position, the carriage 2 will have compressed a return spring 20, whereafter the spring 20 gives off its absorbed energy by pushing the carriage 2 back to the left in FIG. 1. The spring 20 has absorbed the energy from the carriage with the retained fraction, and this energy is sufficient to bring the carriage 2 back to the starting position, where the screen 3 is in the sorting position and where a hook 15 on the locking plate 16 engages another hook on the beam 1, thereby locking the carriage in this position. As the carriage 2 moves back to the starting position, the disc 9 will tighten the wire 7 and bring back the disengagement lever 6 to its vertical initial position. When the carriage 2 is in the starting position, a spring 17 will press the locking plate 16 so as to bring the hook on the locking plate away from the axis of symmetry of the grading plant to engage another hook (not shown) on the beam.

In another embodiment, two double-acting hydraulic cylinders 18 (FIG. 4) are used to move the carriage 2 from the starting position wherein the screen 3 is in the sorting position, to the rear position wherein the screen 3 is in the discharging position. Thereafter the hydraulic cylinders 18 move the carriage back to the starting position. The hydraulic cylinders 18 have a fixed working cycle consisting of a reciprocating motion. This working cycle may be started by means of radio control or by means of a signal from a mechanically activated electric switch, e.g. by the loading machine.

I claim:

1. A grading plant including a self-cleaning screen for receiving lump materials and retaining oversize fractions thereof above a predetermined size, movement means for displacing the screen from a horizontal sorting position to a vertical discharging position and back to the sorting position, and tracks for guiding the screen during its displacement, said tracks having a horizontal portion and a curved, downwardly directed portion connected to the horizontal portion, comprising: a carriage (2), bearings (13) for pivotally supporting the screen (3) approximately in a lateral center of gravity axis in the sides of the carriage, wheels (4) attached to the sides of the carriage in rolling engagement with fixed horizontal beams (1) of the grading plant below the sides of the carriage to enable its horizontal displacement, and two wheels (5) attached to the rear end of the screen and individually guided in the tracks provided with each horizontal beam, the screen being in a position for discharging the retained fractions when the wheels (5) are in a lower part of the curved portion (12) of the tracks, and in a sorting position when the wheels are in a forward part of the horizontal portion (11) of the tracks.

2. A grading plant according to claim 1, wherein the movement means comprises two symmetrically arranged wires (7) each attached at one end to a bracket (10) at a rear end of each beam, guide discs (9) for the wires attached to a front end of the carriage, guide pulleys (8) for the wires fixed relative to each beam at opposite sides of a longitudinal axis of symmetry (14) of the carriage, and a movable disengagement lever (6) connected to the other ends of the wires, whereby movement of the lever away from the carriage causes tension of the wires and, by pressure exerted against the discs, displaces the carriage in a direction away from the lever and towards the rear end of the beams.

3. A grading plant according to claim 2, wherein the discs are individually mounted on two locking means locking the carriage when the screen is in the sorting position, each locking means comprising a plate (16) pivotally mounted to the front end of the carriage and having a hook (15) biased by a spring (17), acting on the plate, into engagement with a corresponding hook mounted on the beam, the locking means releasing the carriage in response to the wires being tensioned by moving the disengagement lever in a direction away from the carriage.

4. A grading plant according to claims 1, 2 or 3, further comprising a return spring (20) mounted on the rear end of each beam for absorbing the kinetic energy of the carriage and the retained fractions on the screen, and for releasing said energy to return the discharged carriage back to its sorting position.

5. A grading plant according to claim 1, wherein the movement means comprises a double-acting hydraulic cylinder (18) mounted on each beam in the longitudinal direction thereof, and a piston of the cylinder connected to the carriage for implementing a reciprocating motion of the carriage.

* * * * *